US006886195B2

(12) United States Patent
Rimbau Vidal

(10) Patent No.: US 6,886,195 B2
(45) Date of Patent: May 3, 2005

(54) FOLDABLE CRADLE FOR BABIES

(76) Inventor: Miguel Rimbau Vidal, Pça. Sant Pere, 7, Girona (ES), 17007

( * ) Notice: Subject to any disclaimer, the term of this patent is extended or adjusted under 35 U.S.C. 154(b) by 0 days.

(21) Appl. No.: 10/471,279

(22) PCT Filed: Mar. 17, 2001

(86) PCT No.: PCT/ES01/00108

§ 371 (c)(1),
(2), (4) Date: Mar. 11, 2004

(87) PCT Pub. No.: WO01/67923

PCT Pub. Date: Sep. 20, 2001

(65) Prior Publication Data

US 2004/0133977 A1 Jul. 15, 2004

(30) Foreign Application Priority Data

Mar. 17, 2000 (ES) ..... 200000732 U

(51) Int. Cl.[7] ..... A47C 27/08
(52) U.S. Cl. ..... 5/98.3; 5/98.2; 5/99.1
(58) Field of Search ..... 5/98.1–98.3, 101, 5/102, 99.1

(56) References Cited

U.S. PATENT DOCUMENTS 2,916,744 A * 12/1959 May et al. ..... 5/102
4,377,011 A * 3/1983 Kinberger ..... 5/102
6,687,928 B1 * 2/2004 Wilson ..... 5/99.1

* cited by examiner

*Primary Examiner*—Heather Shackelford
*Assistant Examiner*—Fredrick Conley
(74) *Attorney, Agent, or Firm*—Jacobson Holman PLLC

(57) ABSTRACT

A cradle includes first and second frames in the form of an inverted "U", the legs thereof crisscrossing and being connected to one another by sliding clamps in the crisscrossing point. Above the crisscrossing points, the structure has a third frame supporting a basket. The third frame is hinged to opposite points of the legs of the second frame and linked to the first frame so that altogether there are at least three connecting points between the first, second and third frames. An element adjustably joining both parts of the first and second frames is provided beneath the crisscrossing points, the element fixing the degree of opening between the frames thereby regulating the height of the basket.

25 Claims, 8 Drawing Sheets

FIG.2
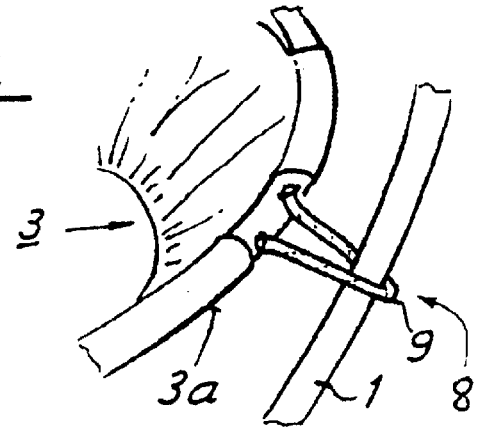
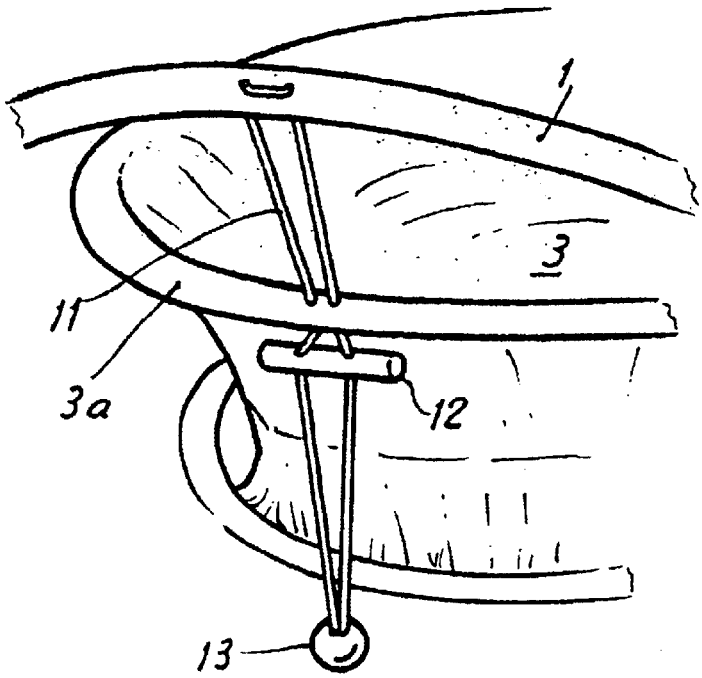
FIG.3
FIG.4
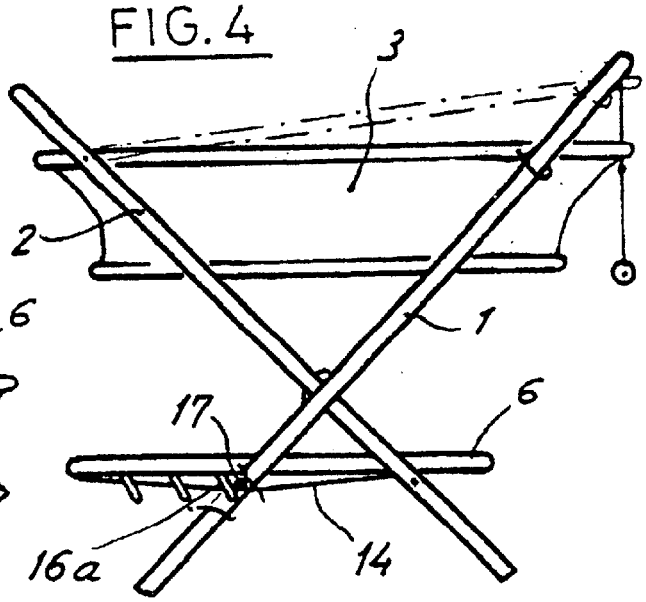
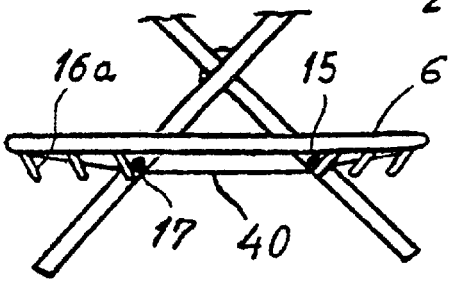
FIG.4a

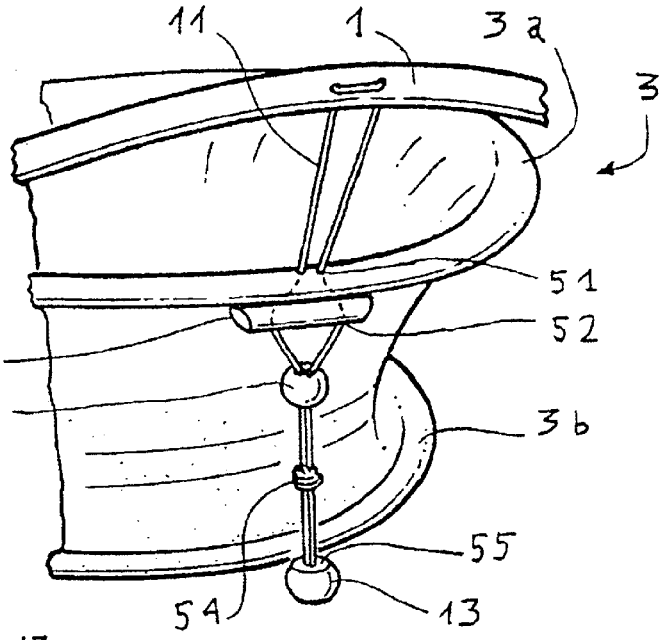
FIG.10
FIG.12
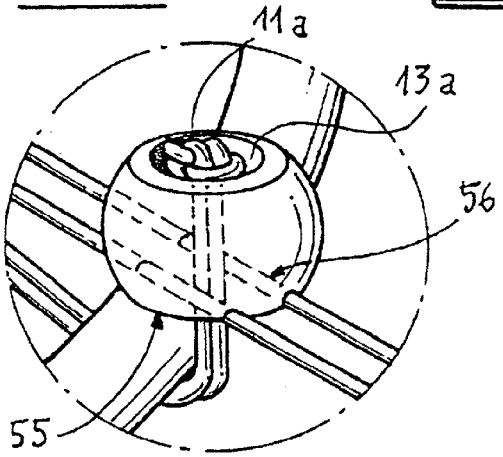
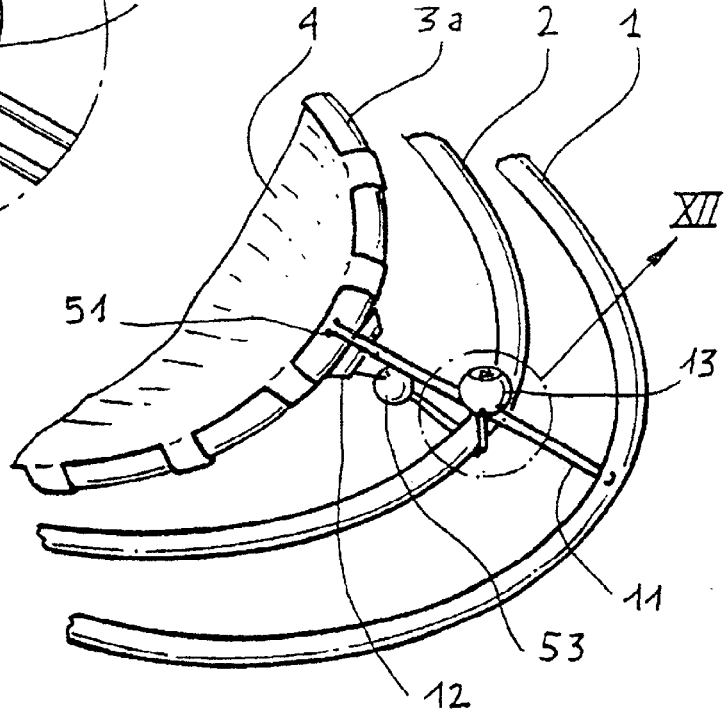
FIG.11

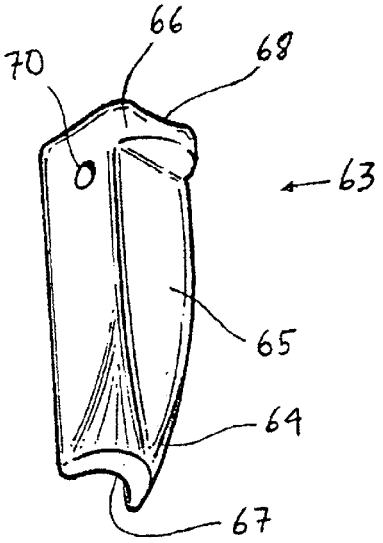
FIG. 13
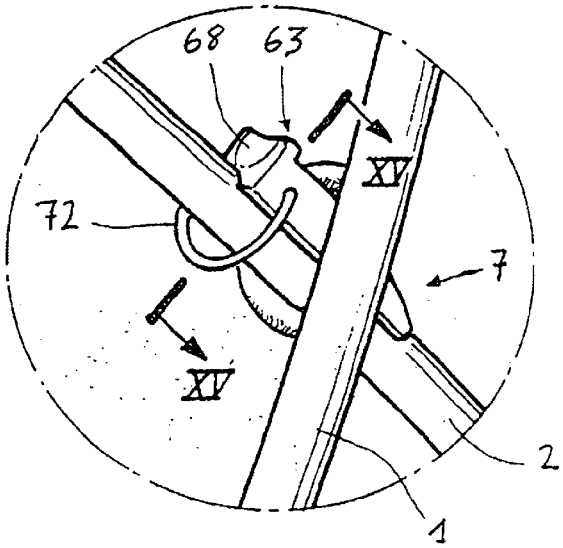
FIG. 14
FIG. 16
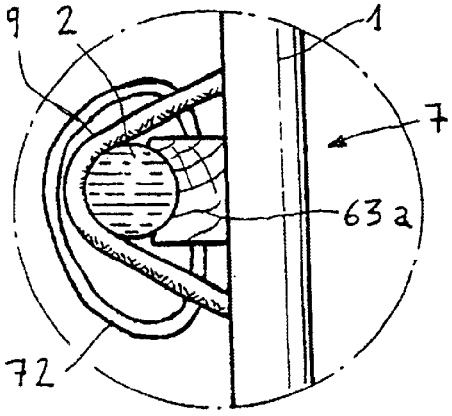
FIG. 15
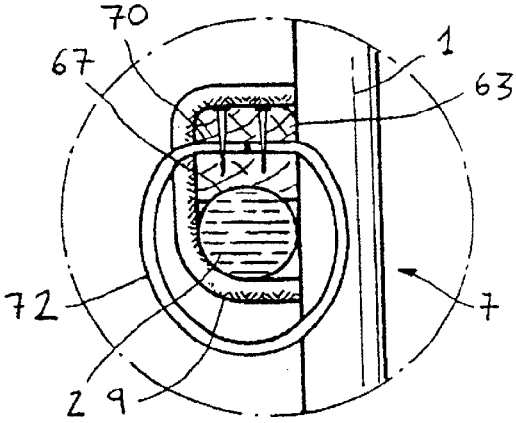

FOLDABLE CRADLE FOR BABIES

This is a nationalization of PCT/ES01/00108 filed Mar. 17, 2001 and published in Spanish.

FIELD OF THE INVENTION

This invention refers to a cradle for babies of the kind which is basically composed of a cot or a cradle proper and a framework to support it, said cot and the framework being both foldable and having a lightweight construction. When unfolded, the set can adopt different possible working positions of the cot within its framework, all of which very stable and allowing to rock the cradle and when folded, the set adopts a flat compact configuration.

TECHNICAL BACKGROUND

In fact, foldable cradles for babies are presently known, for example those disclosed in Utility Models ES-A-275810, ES-A-1000144, ES-A-1014582 and ES-A-1024018, all of them having very similar characteristics, being mainly based on a framework formed by two frames mounted with their sides scissor crossed and hinged to each other in the respective crossing points by means of independent aligned shafts. In the frames, on each side and above said crossing points, crossmembers are arranged on which a cot is arranged. Also, above the crossing points there exists one or several foldable crossbars limiting the opening of said frames and which in some case (ES-A-1014582) are part of the cot bedding structure. Folding said crossbars allows to shut said frames so that both remain approximately leaning against each other. In all the foldable cradles according to above documents, it is required to withdraw the cot before folding the framework. In mentioned model ES-A-1024018, the folding support has a single central crossbar and it has other higher crossbars depending on the removable enclosing sides which have to be released when it is wished to fold the framework.

Anyway, all above disclosed framework for cot or cradle carries a limitation relating to the positions it can adopt, these remaining reduced to a single working position, without possibility of any variation neither in the height nor in the inclination and at the folding position the cot having been previously withdrawn. In addition, in the working position, the possibility or rocking the cradle has not been provided.

In the Utility Model ES-A-294024, said crossbars do not exist but the two frames are linking above their crossing points to straight side lengths of a top horizonal ring serving as support for the respective cot. The link of one of those frames with said top ring comprises hinges with respect to independent shafts aligned at fixed points, while the other frame is linked to the ring by means of couplings in different selectable positions which allows to adjust the height. However, it is not either provided the possibility to rock the cradle and the cot must be withdrawn for folding the set.

Unlike above background, the cradle for babies which is proposed comprises a kind of sliding junction of the frames to each other and with corresponding cot which confers it a condition of greatly stable supporting structure in the working position and provided with a great freedom to allow moving the cot in order it adopts different levels and positions, including the possibility to rock the cradle, while the set, including the cot, in a folded position adopts a minimum bulk being easily transportable, for example, in the boot of a current car.

SHORT EXPLANATION OF THE INVENTION

The supporting structure of the cradle for babies object of this invention is of the kind comprising two generally inverted-U-shaped frames mounted with their sides scissor crossed. The junction of the frame sides to each other at their crossing points is carried out by means of clamps which allow in addition to the wished hinging, that some elements slide with respect to the others. Each of the frames comprise crossmembers arranged between their sides under the crossing points, on said sides and linked to them an element is arranged which limits the frames opening. Said element has available different coupling positions with one or both crossmembers to allow selecting a general height of the cot. The cot, in turn, has available a rigid top ring which is hinged by an area close to the end corresponding to the feet on one of the frames and linked by an area close to the end corresponding to the head, to the other frame by means of clamps, said head end being suspended from related frame by means of a crossbar having an adjustable length allowing to vary the cot general inclination. This cot fastening system cooperates with said lower element in limiting the opening of the frames. The flexibility provided by the junctions by means of clamps allows the possibility to rock the cradle at same time it provides a strong resistance to the supporting structure, increasing its rigidity when higher is the load applied up to a given limit. The cot comprises a second lower ring, both higher and lower rings being joined by means of a fabric forming a side wall. The cot has a fabric bottom, preferably with a supporting surface made of braided fibres or of a plate, as a bed base for a mattress.

It must be pointed out that said combination of rigid structural elements linked to each other by sliding hinges and suspended junctions, jointly with the textile construction of the side of the cot, provide a cradle set having following characteristics:

- a supporting structure in which all the rigid elements admit a given relative moving from each other but the set is very stable and surprisingly strong;
- a suspended cot, with possibility of adjusting its position with respect to the supporting structure as well in height as in inclination, and with capability to be rocked.
- a cradle set, including the cot and said supporting structure, which can be folded up to a very compact and flat position which can be introduced in a case and stored or carried, for example, within the boot of a current car.

According to a preferred example of embodiment, the cradle of this invention is made of cane of the type Manila and Manau and cord of synthetic fibre covered with natural fibre, such as cotton, which provide this cradle with a significant stability, lightness and flexibility, in addition to a warm and natural appearance and touch.

SHORT EXPLANATION OF THE DRAWINGS

These and other advantages will be more apparent from the detailed description below of examples of embodiment of the invention provided only for illustration and not limiting purpose that description including references to the drawings attached in which:

FIG. 1 is a general view in perspective of a first example of embodiment of the cradle of this invention;

FIG. 1*a* is a detailed view illustrating virtually invisible fastening means of half rigid elements such as tensile strength ropes (climbing type or the like) used for joining to each other frames or crossmembers associated thereto.

FIG. 2 illustrates a detail of a junction between the cot and the a frame;

FIG. 3 is another detail showing the cot head adjusting suspension system;

FIGS. 4 and 5 show, respectively, side elevation views of the cradle having the cot high and then low;

Figure 1:
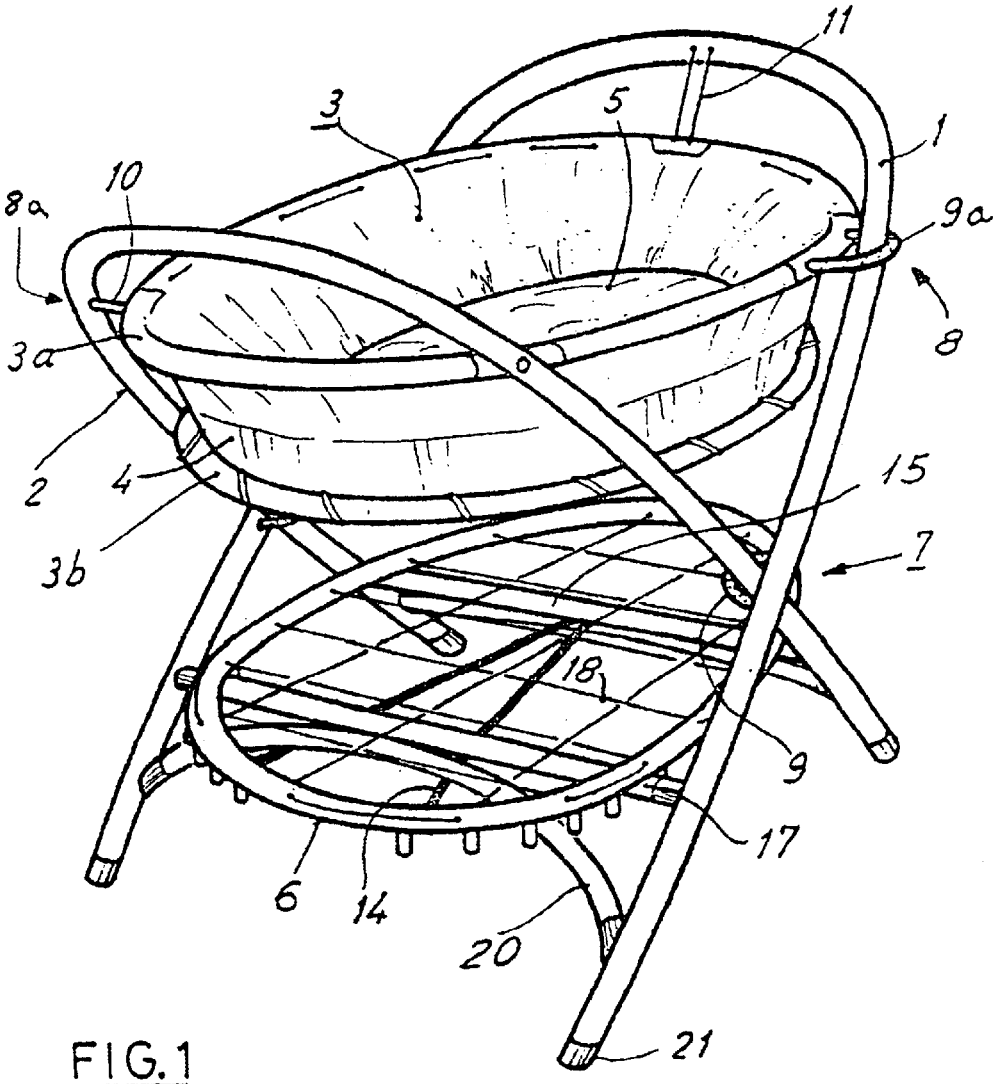
Figure 1A:
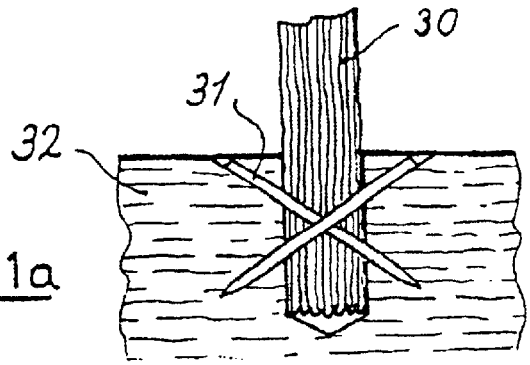
Figure 6:
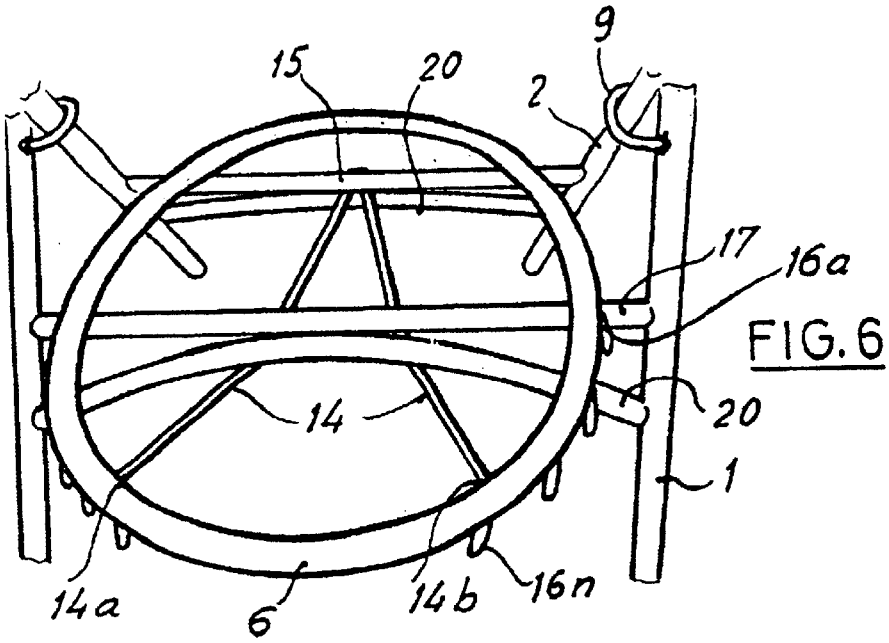
Figure 7:
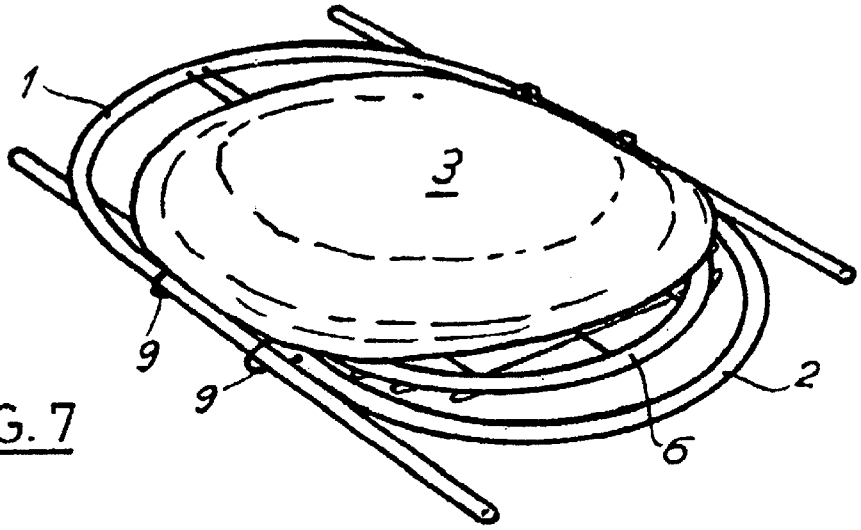
Figure 8:
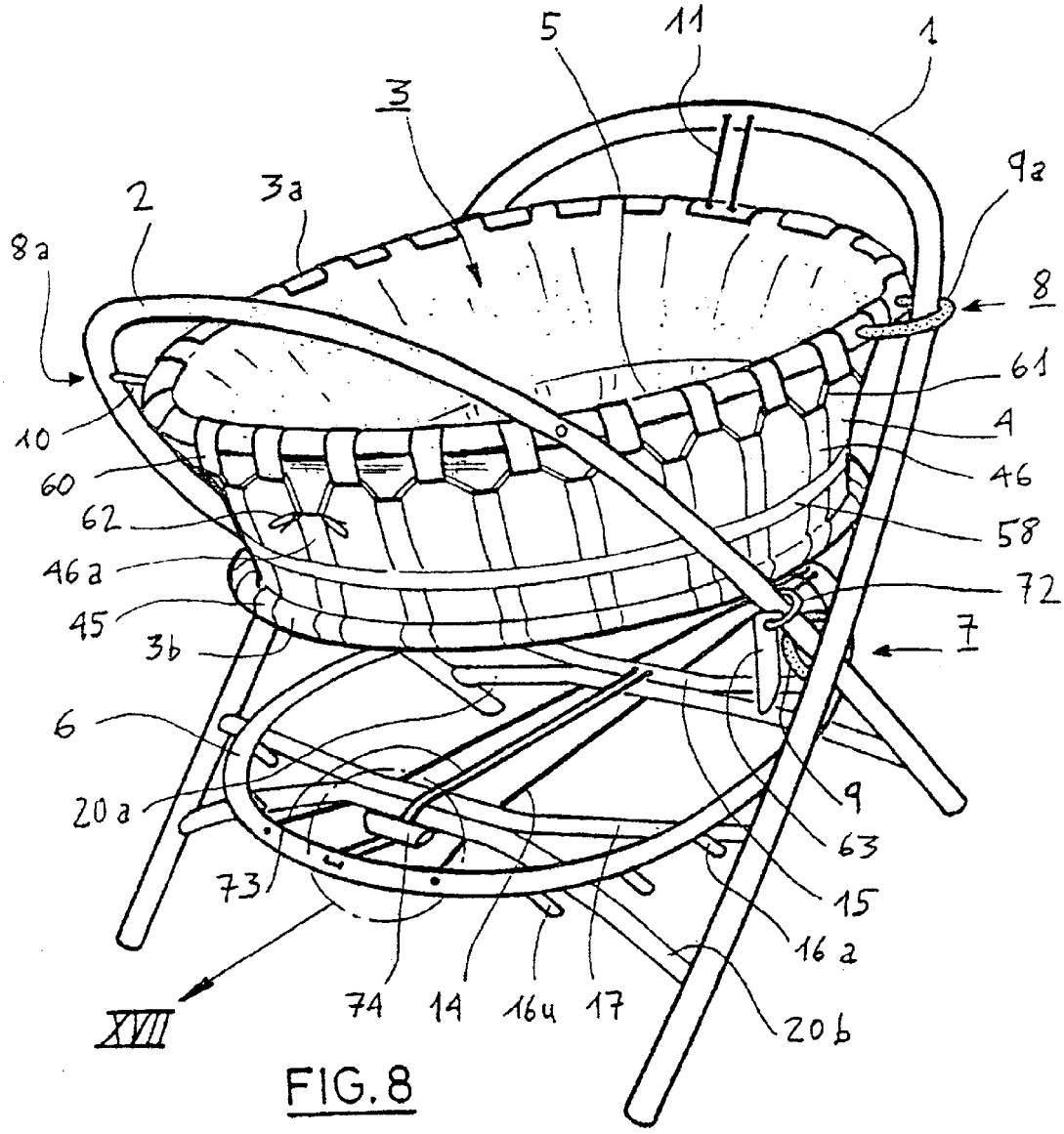
Figure 9:
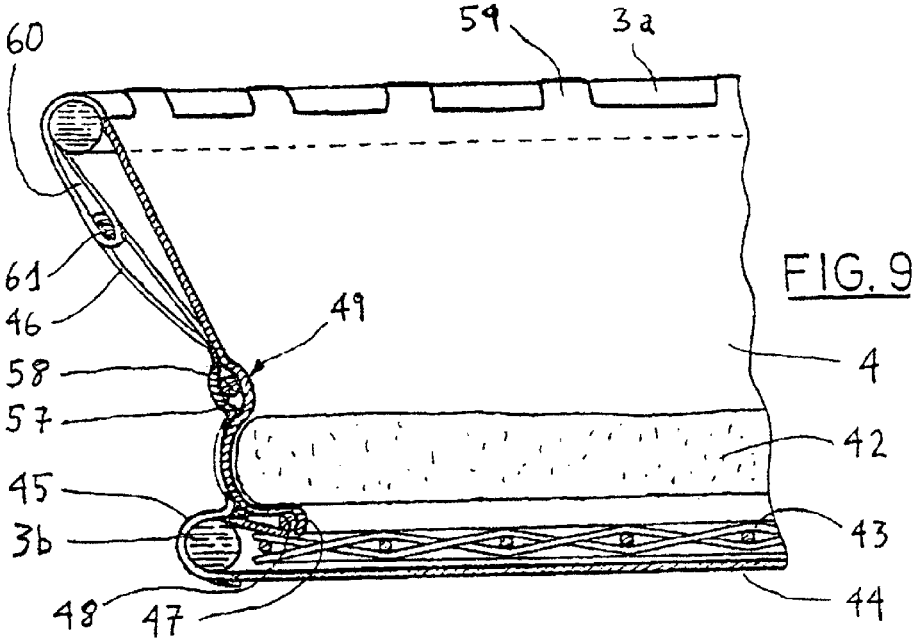
Figure 17:
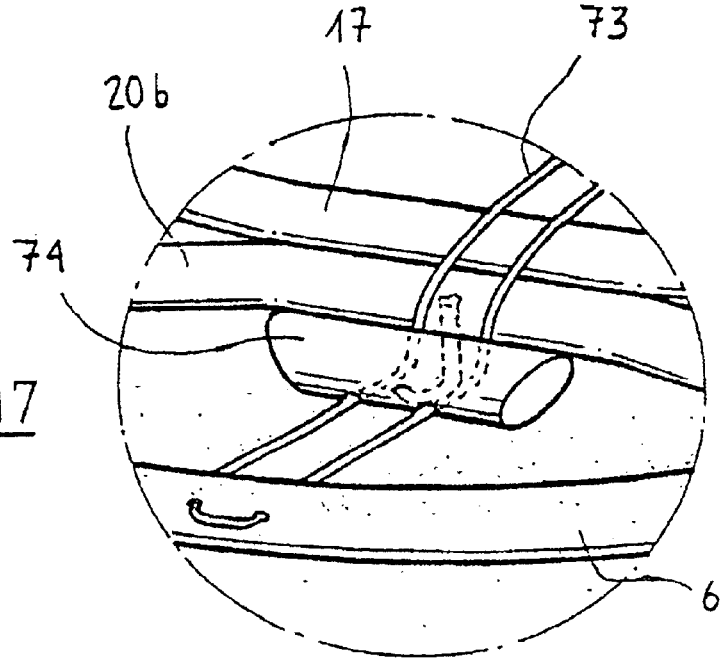
Figure 18:
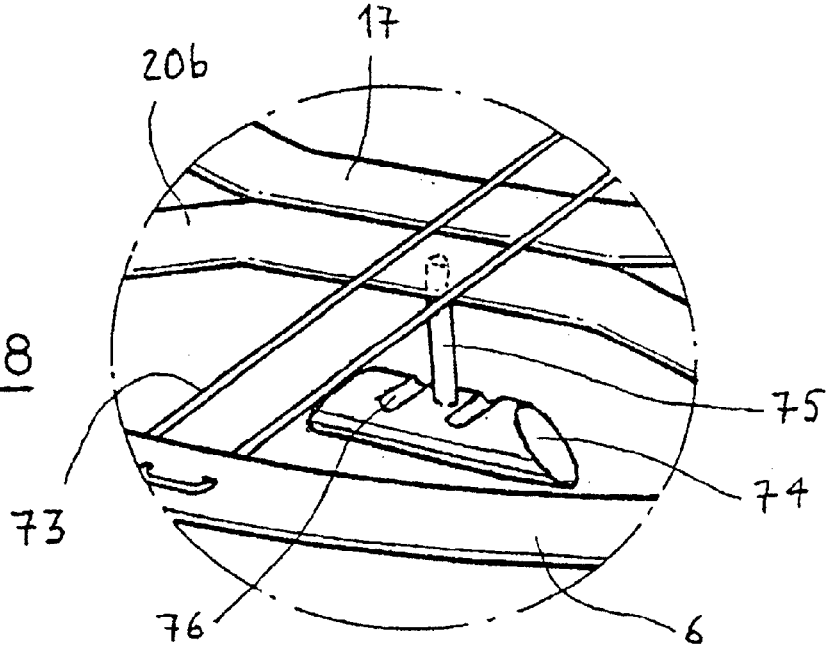

FIG. 4*a* shows an alternative variation of embodiment, of the means for adjustable fasten the level of opening between the crisscrossed frames;

FIG. 6 is a part view of the cradle in which the lowest part thereof can be seen;

FIG. 7 corresponds to a view in perspective of same cradle, including the cot, both fully folded;

FIG. 8 is a general view in perspective of a second example of embodiment incorporating different attachments with respect to the cradle of the example of FIG. 1;

FIGS. 8*a*, 8*b*, 8*c* and 8*d* are views in cross section of different variations for fastening the ropes to different materials composing the cradle;

FIG. 9 is a detail in cross section showing a special make of the cot according to the embodiment of FIG. 8;

FIG. 10 is a part view, in perspective, showing a variation for the cot head adjusting suspending system;

FIG. 11 is a part view in perspective showing the usefulness of an appendage of the adjusting suspending system of FIG. 10 as a safe locking for the cradle in folded position;

FIG. 12 is an enlarged view of the detail XII of FIG. 11;

FIG. 13 is a view in perspective of a device for temporarily annul the capability of the cradle to be rocked;

FIG. 14 is a part view, in perspective, showing the use of the element of FIG. 13;

FIG. 15 is an enlarged cross sectional view taken by plane XV—XV of FIG. 14;

FIG. 16 is an enlarged cross sectional view showing a variation of embodiment of the element of FIG. 13;

FIG. 17 is an enlarged view in perspective of detail XVII of FIG. 8 showing a locking device for preventing a contingent folding of the cradle to its working position; and FIG. 18 is a part view in perspective showing the lock of FIG. 17 in an idle position allowing to fold the cradle.

DETAILED DESCRIPTION OF THE PREFERRED EXAMPLES OF EMBODIMENT

Referring first to FIG. 1, that figure shows a general view of a first example of embodiment of the cradle object of this invention, which essentially comprises following elements:

two generally inverted-U-shaped frames 1 and 2, scissor crossing and connected to each other at the crossing points 7, by means of sliding clamps 9 which admit a relative slide of one with respect to the other.

a third top-ring-shaped frame 3*a* linked to the two frames 1, 2 above crossing points 7, from which top ring hangs a cot 3 composed by said top ring 3*a*, a lower ring 3*b*, a textile side 4 spread between both of them, constituting the cot sides 3 and a conventional fluffy bottom 5, said internal ring 3*b* forms a bed base when stretching said bottom 5; and a lower, substantially horizontal fastening element 6 linked to the two frames 1, 2 under the crossing points 7.

It must be pointed out in this invention that as well the mutual joining of the two frames 1 and 2 on respective crossing points 7 as the link of the top ring 3*a* of cot 3 with frame 1 at respective at crossing points 8 are carried out by means of clamps 9, 9*a* formed by respective half rigid cords, such as for example those of climbing ropes or the like fastened at related leg of the other frame 1.

It is obvious that this kind of junction provides a great freedom of hinging and sliding to frame 1 with respect to the other frame 2 and the ring 3*a* of the cot 3. Even more, said freedom of hinging or clearance even provides the possibility to move the cradle swinging or rocking it as it is many times convenient with this kind of children furniture.

The top ring 3*a* of the cot 3 is in addition secured by other points as it can be seen in FIG. 1: by the area of the feet it is supported and hinged at two points 8*a* opposed to the frame 2, which in the case illustrated is made by cords 10 acting as junction with possibility of twisting; by the area of the head the top ring 3*a* of the cot 3 is suspended from the centre of the inverted "U" of frame 1 by means of a pair of cords 11 (see also FIG. 3) which cross very close to the top ring 3*a* of cot 3*a* and then they sharply depart from each other for crossing a small sliding block 12, for example a piece of cane, from which they come down and gather together lower at a ball 13 which encloses the joined ends cords 11 which in addition act as safety stops. This arrangement allows to shorten or lengthen the length of cords 11 suspending the cot 3 levelling, therefore, or inclining if it is wished so, the position of the cot proper.

This way, said top ring 3*a* is joined to frames 1 and 2 by at leat three points and preferably by five different points by means of different elements which cooperate with each other for basically carrying out two functions: on one hand, limiting the opening of the frames 1, 2 above crossing points 7 cooperating with the fastening element 6 which makes it under the crossing points 7; and on the other hand, supporting cot 3 in a stable and adjustable position allowing its swinging.

It must be pointed out that the term "inverted-U-shaped" intends to cover any configuration showing two downwardly extended legs joined at their top part by some structural element, which can have same or different nature than the legs and can form with them sharp or rounded angles or, as shown in the figures, be formed by a conveniently curved tubular, cored or uncored profile. On the other hand, the term "ring" intends to cover any elongate, cored or uncored element or elements, with their ends joined to each other forming a closed outline. The term "rope or half rigid cord" intends to cover any kind of rope or cord having low tensile elastic elongation.

Another important characteristic of the cradle object of this invention is the inclusion of said fastening element 6 (FIGS. 4, 4*a*, 5 and 6) which, in the example illustrated, adopts the shape of an oval ring and which is hinged, in a way similar to ring 3*a*, by means of a cord or rope (not shown) to crossmember 15. In addition, two wads of elastic cotton 14 have been provided which at one end are fastened at two spaced points 14*a*, 14*b* (in order to increase its action of elastic recovery actively assisting folding and unfolding) of frame 6 proper corresponding to the feet of the cradle and which passing under the crossmember 17, converge at the other end and are going to be fastened at respective crossmember 15 joining frames 1 and 2 (see FIGS. 4 and 4*a*) for understanding the functional nature of that arrangement). Said elastic cotton wads 14 fasten the fastening element 6 against the crossmember 17.

Figure 5:
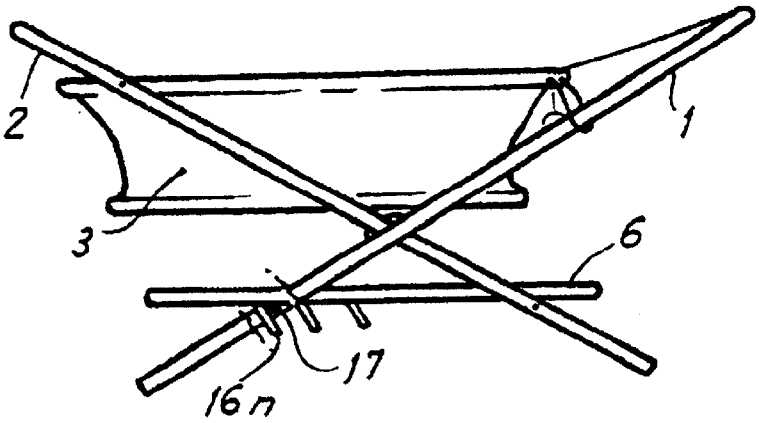

A main aim of said fastening element 6 is to provide pairs of teeth or appendages 16*a* . . . 16*n* for retaining the other crossmember 17 joining the legs of frame 1 in order to be able to graduate and establish the position of the cradle proper, that is to say, high position with those frames 1 and 2 slightly open and low position with those frames very open, as it is illustrated in previous FIGS. 4 and 5. So then, while in one of the case there are the teeth 16*a* which hook the crossmember 17, in the other case, there are teeth 16*n* which hook said crossmember. As it has already be told, said teeth 16*a* . . . 16*n* are arranged by pairs, that is to say, at one and the other (directly opposite) sides of the curve of said horizontal frame 6 (FIG. 1). Obviously, the number of teeth 16*a* . . . 16*n* can vary depending on whether a greater or a smaller number of positions or levels of cot 3 are wished.

In the example of embodiment of FIG. 4*a*, sets of teeth 16*a* . . . 16*n* have been provided at the two ends of fastening element 6 and fastening said frame 6 on the crossmember is only obtained by an elastic means 40 which extends from a first to a second ends distal from frame 6 passing under crossmembers 15 and 17, therefore to release them one or the other end can be indistinctly lifted.

The moving fastening of fastening element 6 on crossmembers 15 and 17 providing the elastics wads 14 facilitates hooking and unhooking its teeth 16*a* . . . 16*n* and with it the possibility to raise or take down the plane of the cradle opening to a larger or lesser degree the crisscrossing between frames 1 and 2.

Another added mission to said fastening element 6 is to serve as platform or rack for housing some children garment or other accessory (not shown). For this, said frame 6 has a grating 18 which is not shown in FIG. 6 not to clutter the drawing but which can be seen in FIG. 1.

For a higher strength and stability of the set of the cradle, a second reinforcing crossmember 20*a*, 20*b* has been arranged close to each conventional crossmember 15, 17; in this example, said second crossmember 20*a*, 20*b* has an arcuate shape.

By unhooking teeth 16*a* . . . 16*n* from the frame the cradle involved can be fully taken down and folded (FIG. 7).

In addition a ferrule 21 is provided at the lower end of each leg of frames 1 and 2, which preferably will be of metal and will act as dolly against the floor. In addition, each of the ends of the crossmembers and junction points of the cane forming the arches are surrounded by a metallic sleeve reinforcing said parts avoiding their opening or breaking.

As suitable material for the ropes and cords, half rigid cords are preferred, namely those made of a synthetic plastic material core covered by one or more layers of natural fibre, such as cotton. The presence of said plastic material core allows to finish the yarns by heat fusion avoiding their flying apart.

As material for said frames 1 and 2, top and lower rings 3*a*, 3*b* and fastening element 6, natural material are preferred of those traditionally used in basketwork and for producing furniture, such as Manila and Manau canes, which are uncored canes. However, other natural products can be used such as bamboo cane, which is cored and wood or artificial products such as different plastic profiles or even cored metallic tubes, for example of steel or aluminium.

However, matching natural canes and ropes or cords covered with cotton makes the set of the cradle extraordinarily lightweight, very stable and strong and has an appearance and a touch warm and natural.

Referring now to FIGS. 8 to 18, same shows a second example of embodiment of the cradle of this invention which participates of same basic elements as the example of embodiment disclosed with respect to FIGS. 1 to 7 and which in addition incorporates a number of improvements. In these FIGS. 8 to 18 and for making it clearer, analogous elements of the first example of embodiment have been designated with same numerals.

Thus, the cradle of the second example of embodiment shown in FIG. 8 also shows a supporting structure formed by two frames 1 and 2, generally inverted-U-shaped, mounted with its side legs scissor crossed and linked to each other at crossing points 7 by means of clamps 9 of rope, a third frame 3*a* having the shape of a ring sustaining the cot 3, linked to the two frames 1, 2 above the crossing points 7 and an element also ring-shaped 6 linked to the two frames 1, 2 under the crossing points 7.

In FIGS. 8*a* to 8*d* different embodiments are shown of the embedded junction of rope yarns 30 (representing the ropes forming the junctions 9, 9*a* and 10) in structural elements 32, 36, 37 (representing elements 1, 2, 3*a* and 6), according to different possible materials.

Figure 8A:
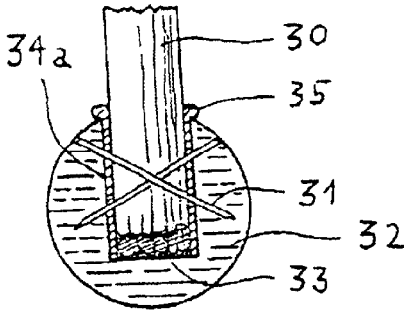

FIG. 8*a* shows an uncored structural element 32 with a hole in which it is introduced in a sleeve 34*a*, for example of brass, with an end of mouth 35 flanged for smoothing the edge and in said sleeve 34*a* a rope yarn 30 is introduced, preferably with its end 33 heat fused. Pins 31 diagonally stuck from the sides in the structural element 32 fasten yarn 30 and sleeve 34*a* in the hole. Sleeve 34*a* acts as protector of rope 30 against hole edges rub and as embellisher.

Figure 8B:
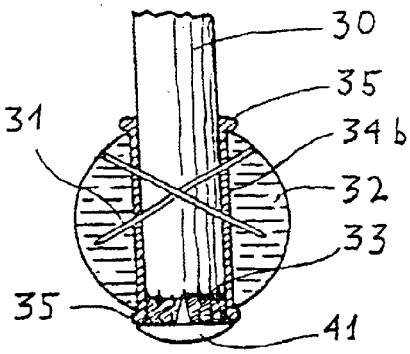

FIG. 8*b* shows an alternative variation for an uncored structural element 32, in which the hole is a through hole and a sleeve 34*b* also a through sleeve, is flanged at both ends 35. Obviously, the flanging of at least one of the ends of through sleeve 34*b* is carried out after it has be completely introduced in the hole. Pins 31 also secure yarn 30 and sleeve 34*b* in the hole of structural element 32, and a finishing embellishing tack 35 is stuck at the heat fused end 33 of yarn 30.

Figure 8C:
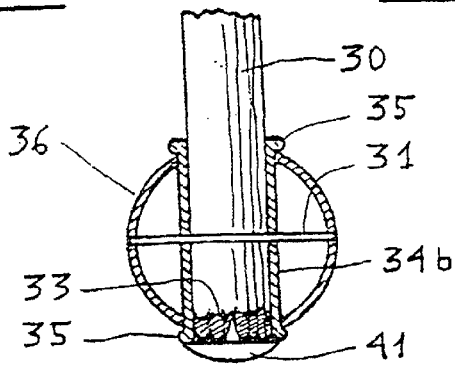

In FIG. 8*c*, the structural element is a cored tube 36, for example of plastic or metallic material, in which a through cross hole has been pierced by means of a cutting process, such as drilling, without deforming the tube. Here also a through sleeve 34*b* has been arranged flanged at both ends 35 and a crossed pin 31 passed through a small through hole of the tube for securing the yarn 30 in the sleeve 34*b* within the hole of the structural element 32. Also, an embellishing tack 35 finishes the yarn 30 heat fused end 33.

Figure 8D:
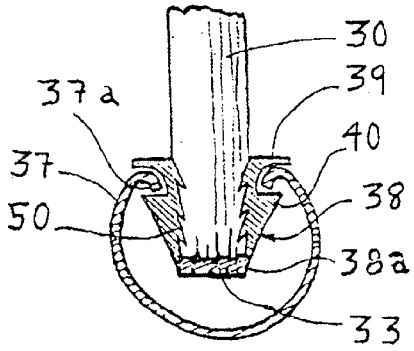

The variation of FIG. 8*d* shows a structural element shaped as a cored tube 37, preferably metallic, in which a blind cross hole has been pierced, that is to say, affecting only one of the walls of the tube, and using a die cut process, current in the sector, which produces as side effect a plastic deformation of the tube having the shape of edges 37*a* turned inwardly the hole. On the other hand, the rope yarn 30 is introduced within the central hole of an anchoring part 38 of a plastic material such as nylon and has its end 33 heat fused together with a final end 38*a* of said anchoring part 38, so that the rope 30 and the anchoring part 38 are joined integral to each other said end 38*a* of the anchoring part 38 has a size which can pass through said hole of the tube 37 while the opposite end shows a stop rib 39 which in addition conceals the deformation of the tube at the entrance of the hole. Under said rib 39, the anchoring part 38 shows a protruding configuration 40, wedge-shaped allowing to introduce under pressure the anchoring part 38 together with the rope 30 in the hole until stoping against rib 39 and thereafter it prevents the withdrawal thereof as the edges 37*a* remain turned inwardly the hole trapped between rib 39 and the protruding configuration 40. This protruding configuration 40 can be continuous around the anchoring part 38 or have the shape of several teeth or pawls distributed equidistant. Preferably, the internal hole of the anchoring part 38 comprises small sawtooth-shaped protrusions (50) for best fastening rope 30.

A description of the construction of cot 3 is made below with reference in general to FIG. 8 and specifically to FIG. 9, showing a part view in cross section thereof.

Same as in the example of embodiment of FIG. 1, the cot 3 comprises a higher ring 3*a* and a lower ring 3*b* joined by a textile side 4 and a fluffy bottom 5. However, in this second example of embodiment of the cot 3 shown in FIGS. 8 and 9, the fluffy bottom 5 is provided by a mattress 42, of any of the material current in the sector, arranged on a supporting surface 43 joined to said lower arch 3*b* of cot 3 covering the internal area thereof and constituting as a whole a bed base. This supporting surface 43 can be of any continuous laminar material although a material obtained by braiding, interlocking or interweaving natural fibres is preferred, such as osier (shown in FIG. 9) or the meshing of cane strand, which is extraordinarily light and strong and which can be produced and mounted on the lower ring 3*b* by means of automated processes. The supporting surface 43 fixed to the lower ring 3*b* is arranged on a fabric background 44 joined to the textile side 4 of the cot 3, preferably through equidistant large ribbons or bands 45, which are upwardly extended sewed on the external face of the textile side 4 until finishing in overhanging curls 46. Preferably, the opposite ends of said bands 45 are extended sewed on the lower face of the fabric base 44, towards its centre, acting as reinforcement.

The textile side 4 of the cot 3 comprises at its internal face, close to the fabric bottom 44, a perimetric flange 47 formed by a fabric hem having an elastic band 48 within it. The tension of this elastic band 48 keeps said flange 47 in projection inwardly cot 3 catching the lower ring 3*b* of the bed base in an easily releasable way. In a similar way, the textile side 4 comprises a perimetric sheath 49, preferably formed in cooperation with a perimetric band 58 externally sewed so that it fastens the bands 45 at the limit from which the curls begin 46. Within said sheath 49 another elastic band 57 is located which tends to close the textile side 4 forming a gullet which slightly trap the mattress 42 in an easily releasable way. The fastening of the bed base ring 3*b* and the mattress 42 respectively provided by the flange 47 and the sheath 49 is specially useful when the cradle set is folded to store or transport it.

From the higher edge of textile side 4 equidistant large bands or ribbons 59 are protruding which are folded on the higher ring 3*a* and which finish in curls 60 which remain in positions intercalated with said curls 46 of the lower bands 45. A soft rope or cord 61 passes consecutively and alternately through all the curls 46, 60 and the two yarns of said rope 61 are fastened with a loop 62 linking the textile side 4, together with all the parts forming the fluffy bottom 5, to the higher ring 3*a*. The knot of loop 62 can be concealed within a central lower curl 46*a* of an end of cot 3, which is less long that the rest of the lower curls 46.

Now referring to FIGS. 10 to 12, a variation of the means for adjusting the level and/or inclination of cot 3 with respect to the horizontal, which consist, same as in the embodiment disclosed with relation to FIG. 1, in two cords 11 attached to a central area of frame 1 corresponding to the head of said cot 3, said cords crossing the third frame 3*a* by the holes 51, adjusted to the diameter of cords 11 and relatively close to each other. Thereafter, and under the third frame 3*a*, cords 11 cross two other holes 52, also adjusted, pierced in a small sliding block 12 such as a piece of cane or similar. Said holes 52 are more separate than said holes 51, therefore said small sliding block 12 is acting as a brake fixing the variable length of said cords 11 between third frame 3*a* and frame 1. The ends of said cords 11 are finally gathered through a central hole of a ball 13 provided with a recess 13*a* which houses a knot 11*a* of cords 11 ends. However, in this variable of FIGS. 10 to 12, between said small sliding block 12 and said ball 13, cords 11 pass through the central hole of another ball 53 which is acting as a safety stop for small sliding block 12 and between both balls 13, 53, there is a knot of cords 11 acting as limit of ball 53 run. On the other hand, ball 13 comprises a plane 55 facing said knot 53. On the other hand, ball 13 comprises a plane 55 facing said knot 54 and two parallel slots 56 located on said plane 55 on both sides of its central hole. Thus, when the wedge set is in folded position, ball 13 can pass between the two cords 11, at a higher length of them, securing itself on them with said slots 56 and trapping the end of the fastening element 6, securing said folded arrangement.

With relation to FIGS. 13 to 15, a device is disclosed below for temporarily annulling or reducing to a large extent, the cradle swinging capacity. That device comprises a pair of plugs 63 which can be inserted between the different elements present at said crossing areas 7 of frames 1, 2 in order to stretching clamps 9 until substantially locking the relative motion between frames 1, 2. For this aim, each plug 63 comprises an elongated body provided with a pointed end 64 for making its penetration easy within related clamp 9, said elongated body gradually widening up to an area having a constant cross section 65, for example rectangular with rounded corners ending by a stop 66 which protrudes by one of its sides. The end of the elongated body adjacent to stop 66 shows a rounded offset 68 adapted for receiving the tip of the thumb in order to exercise a pressure. The face of the side opposite to the stop 66 comprises, in its whole extent, a longitudinal groove 67 having a curved profile bottom with a radius approximately equal to the radius of the cross section of frame 2 cane. Close to said end adjacent to stop 66 there is a through hole 70 through which ends the yarns of a piece of rope (FIG. 15) has been introduced which is fastened there by means of points 71 stuck from outside in the elongated body. Said piece of rope 72 remains thus forming a curl around the leg of frame 2 the plug 63 being able to freely slide along it. The aim of rope 72 is only to keep plug 63 linked to the wedge set for avoiding it is lost.

The shape and perimeter of constant cross section 65 of plug 63 agrees with the diameter of frame 2 leg and clamp 9 length in order that, when plug 63 is introduced under pressure between clamp 9 and frames 1, 2 at the crossing area 7, with groove 67 applied to frame 2 leg (FIG. 15), clamp 9 remains stretched locking the clearance of said elements present at the crossing area 7. Obviously, plug 63 can be introduced in clamp 9, indistinctly above or under frame 2.

An equivalent result is obtained with a plug 63*a* (FIG. 16) drawn with shapes and sizes suitable for being inserted between frame 1 and frame 2 with the groove applied against this later.

In FIGS. 17 and 18, a safety device is shown (also visible in FIG. 8) for preventing an unwanted folding of the cradle when it is in its working position. More concretely, this safety device has the object of positively preventing an unwanted lifting of the end of fastening element 6 and subsequent release of appendages 16*a* . . . 16*n* coupling with crossmember 17, the trend to lift so being also prevented by said elastic cords 14.

A pair of ropes 73 are laid, parallel, close to each other and slightly stretched, from a central area of the end of the fastening element 6 in which appendages 16*a* . . . 16*n* are located until a central area of crossmember 15 or its attached reinforcement 20*a*, passing above the opposite crossmember 17. A clasp 74 having the shape, for example, of a piece of cane having a length higher than the distance between said pair of ropes 73, is suspended from a central area of opposite crossmember 17 or of its attached reinforcement 20*b*, by means of at least a short piece of rope 75 fixed to its central area. Said clasp 74 shows, on both sides of said short piece of rope 75, a pair of slots 76 separated by a distance according to the separation of the pair of ropes 73. With the set in working position, the clasp 74 passing between said pair of ropes 73 and crossing above them so that said pair of ropes 73 remains stretched and retained in said slots 76 (FIGS. 8 and 17), it is achieved to fasten the fastening element 6 against crossmember 17 preventing the possibility that appendages 16*a* . . . 16*n* are unwillingly disconnected from said crossmember 17.

On the other hand, leaving clasp 74 shifted such as in FIG. 18, the cradle is kept in stable working position (and sufficiently safe if there are no special risk factors) thanks to the action of said elastic cords 14 and prepared to be folded with prior lifting of fastening element 6 against the elastic strength of cords 14.

Main elements composing this cradle having been broadly illustrated and described, for example purpose, it is stated that the cradle object of this invention can be made with the most convenient materials and means and with the most suitable shape and size and that a man of the art can devise many variations without being out of the scope of this invention, which is defined in claims attached.

What is claimed is:

1. Foldable cradle for babies comprising a structure composed of a first and a second inverted-U-shaped frames, which may adopt an arrangement with its legs scissor crossed adapted for supporting a cot, said first and second frames being connected to each other by sliding clamps at the crossing points, said structure comprising above said crossing points a third frame which supports said cot hinged at opposite points of the two legs of one of said first and second frames and linked to the other of said first and second frames so that there exists as a whole at least three connecting points between said first, second and third frames, and the structure integrating under said crossing points an element provided with selectable linking means for linking parts of said first and second frames, in a crossed arrangement, fixing the degree of opening between them and in addition adjusting the height of the cot.

2. Cradle according to claim 1, wherein said third frame adopts an oblong annular configuration and one of said three connecting points has an adjustable condition allowing to adjust the level or inclination of the cot.

3. Cradle according to claim 2, wherein the material of the tubular elements constituting the frames and other elements of the supporting structure comprises cane and the rings are obtained by joining end-to-end the respective ends of a formed cane with a central connecting peg and a protecting wrapping sleeve.

4. Cradle according to claim 3, wherein the ends of the canes are covered by a ferrule and the ends of the cross-members remain surrounded by a metallic ring which stiffen said ends of the canes.

5. Cradle according to claim 2, wherein the connection of the third frame to the second frame is carried out by two sliding clamps at its crossing points and a suspending element having an adjustable length.

6. Cradle according to claim 5, wherein the means for adjusting at least one of the level and inclination of the cot with respect to the horizontal consist in two cords fastened at a central area of the first frame, said cords crossing the third frame through holes, adjusted and relatively close to each other, and thereafter, under the third frame, crossing two other adjusted holes pierced in a small sliding block, said other adjusted holes being more separate than said holes, and therefore said small sliding block acts as a device fixing the variable length of said cords, the ends of said cords being gathered through a central hole of a ball provided with a recess which houses a knot of the ends of the cords.

7. Cradle according to claim 6, wherein between said small sliding block and said ball the cords pass through a central hole of the other ball which acts as safety stop for the small sliding block and between both balls there is a knot of the cords which acts as limit of the ball run and in that the ball comprises a plane facing said knot and two slots parallel on said plane on both sides of its central hole, said ball, with the whole of the cradle in folded disposition, passes between the two cords, at a length higher than them, retaining them in said slots and trapping the opposite element securing the folded disposition.

8. Cradle according to claim 5, wherein said sliding joining clamps are constituted by a cord describing a curved path and that within it loosely encompasses the leg of a corresponding first or second frame, the ends of said cord being fastened on respective holes of the other corresponding first, second or third frame.

9. Cradle according to claim 8, further comprising a pair of plugs slidingly linked to the legs of the first or second frame by a piece of rope, said plugs have at least a portion having a shape and size suitable for the sizes of the cross section of said legs of the first or second frame and to the length of said cord forming clamps in order to temporarily and substantially lock the relative motion between frames by stretching clamps produced by the insertion of said portion of said plugs at the crossing areas either between the legs of first and second frames or between said first or second frame and the ropes forming clamps.

10. Cradle, according to claim 1, wherein said cot is formed by said third frame which is in a form of a higher ring, a lower ring supported on said higher ring, a side and a bottom of the cot.

11. Cradle according to claim 10, wherein said side and bottom are made of a flexible textile material and the side and the bottom are joined to each other, the side includes on an internal face and close to the bottom, a perimetric flange projecting inwardly from the cot by an elastic cord or ribbon associated with it, trapping the lower ring of the cot in an easily releasable way and a second perimetric elastic ribbon associated to the side at a given height of said flange tends to close the side of the textile material forming a gullet above a mattress trapping it slightly in an easily releasable way.

12. Cradle according to claim 11, wherein said side comprises a series of equidistant lower curls, formed upwardly overhanging by large bands or ribbons sewed on its external face and a series of equidistant higher curls downwardly directed, formed by other large bands or ribbons which start from the higher edge of the side of the textile material folding on the higher ring, said higher curls remain in intercalated positions with said lower curls and a smooth rope with its yarns fastened in a loop is passing consecutively and alternately through all its curls linking the textile side together with the bottom to the higher ring.

13. Cradle according to claim 10, further comprising a supporting surface joined to said lower ring of the cot covering the internal area thereof, forming as a whole a bed base for a mattress, the material of said supporting surface is selected from a continuous laminar material; an openworked or perforate laminar material; and a laminar material obtained by braiding, interlocking or interweaving half rigid artificial or natural fibres including osier basketwork or meshing of cane strand.

14. Cradle according to claim 1, wherein each of the first and second frames comprises between its legs at least a respective joining crossmember tightly fixed by its ends, by an element to the section of said legs.

15. Cradle according to claim 14, wherein said crossmembers are straight or arcuate or elbowed with their top part concave and close to each crossmember, a reinforcing crossmember is provided arcuate or elbowed at its convex top part.

16. Cradle according to claim 14, wherein said element for fastening the degree of opening between the legs of the first and the second frames is constituted by an oblong ring hinged to said crossmember which is joining the legs of the second frame and provided with a series of appendages which protrude from an opposite end, which is geared or coupled on said other crossmember which joins the legs of the first frame, an elastic element being arranged associated to said ring actively assisting to the opening and closure of the set, constituted by at least a flexible cord joined by one of its ends to the end which has said appendages of the ring said flexible cord extending under said crossmember of the first frame and is joined by the other end to said frame or attached reinforcement of the second frame or to the end distal to the ring.

17. Cradle according to claim 16, wherein the inside of said ring-shaped fastening element is occupied by a grating acting as a rack.

18. Cradle according to claim 17, wherein the fastening of ropes to cored or uncored tubular elements of frames or crossmember comprises an end sector of rope, with its strands heat fused, introduced in a hole for respective tubular elements and at least one fastening element for fastening rope in position within said hole.

19. Cradle according to claim 18, wherein said fastening element comprises at least one pin introduced from outside an uncored or cored tubular element crossing rope within the hole.

20. Cradle according to claim 19, wherein said hole is blind and a metallic sleeve is arranged around rope within the hole and with a flanged end at the mouth, said metallic sleeve being also crossed by said pin which is at least one.

21. Cradle according to claim 19, wherein said hole is a through hole and a metallic sleeve is arranged around rope within the hole and with both ends flanged at the mouths, said metallic sleeve being also crossed by said pin, which is at least one and with a finishing tack stuck in the fused end of the rope.

22. Cradle according to claim 18, wherein said tubular element is a cored metallic tube and said hole is a blind hole, said fastening element comprising an anchoring part of a plastic material, which has its end heat fused together with a final end of said rope passed through a central hole of toothed walls of said anchoring part, which externally shows at its external end a stop the rib and under it a wedge-shaped protruding configuration which allows to introduce under pressure the anchoring part together with the rope in the hole until stopping against the rib and preventing the withdrawal thereof when edges of the hole are trapped between the rib and protruding configuration.

23. Cradle according to claim 16, wherein said hinged junctions of the ring to the crossmember and the third frame to the frame comprise small lengths of flexible cord and with possibility of twisting, with its ends fixed on respective ring and crossmember or second and third frame.

24. Cradle according to claim 14, wherein said element for fixing the degree of opening between the legs of the first and second frames is constituted by an oblong ring provided with two distal ends protruding overhanging above said crossmembers, at the ends of which are arranged a series of appendages which may be respectively geared or coupled on said crossmembers, remaining fastened to them by an elastic element which starts from one of the parties of said distal ends of the ring and extending under said two crossmembers.

25. Cradle according to claim 14, further comprising a pair of laid parallel ropes close to each other and slightly stretched from a central area of the end of the fastening element in which there are appendages up to a central area of the crossmember or its attached reinforcement, passing above the opposite crossmember and a clasp having a length longer than the distance between said pair of ropes, suspended from a central area of the crossmember or from its attached reinforcement, by at least of a short piece of rope fastened at its central area, said clasp is passed, when the set is in a working position, through said pair of ropes and crossed above them so that said pair of ropes remain stretched and retained, locking the fastening element against the crossmember for preventing the appendages from unwillingly being uncoupled from said crossmember.

* * * * *